US010961791B2

(12) United States Patent
Fleckenstein et al.

(10) Patent No.: US 10,961,791 B2
(45) Date of Patent: Mar. 30, 2021

(54) METHOD AND APPARATUS TO ROTATE SUBSURFACE WELLBORE CASING

(71) Applicant: COLORADO SCHOOL OF MINES, Golden, CO (US)

(72) Inventors: William W. Fleckenstein, Lakewood, CO (US); Alfred W. Eustes, III, Superior, CO (US)

(73) Assignee: COLORADO SCHOOL OF MINES, Golden, CO (US)

( * ) Notice: Subject to any disclaimer, the term of this patent is extended or adjusted under 35 U.S.C. 154(b) by 0 days.

(21) Appl. No.: 16/410,043

(22) Filed: May 13, 2019

(65) Prior Publication Data

US 2019/0277096 A1 Sep. 12, 2019

Related U.S. Application Data

(62) Division of application No. 14/979,105, filed on Dec. 22, 2015, now Pat. No. 10,287,829.

(60) Provisional application No. 62/095,319, filed on Dec. 22, 2014, provisional application No. 62/248,084, filed on Oct. 29, 2015.

(51) Int. Cl.
*E21B 33/14* (2006.01)
*E21B 17/22* (2006.01)

(52) U.S. Cl.
CPC ..... *E21B 17/22* (2013.01); *E21B 33/14* (2013.01)

(58) Field of Classification Search
CPC ..... E21B 17/22; E21B 33/14
USPC ..... 166/244.1, 285
See application file for complete search history.

(56) References Cited

U.S. PATENT DOCUMENTS

| | | | |
|---|---|---|---|
| 2,085,115 | A | 6/1937 | Moineau |
| 3,753,628 | A | 8/1973 | Becker |
| 3,932,072 | A | 1/1976 | Clark |
| 4,033,640 | A | 7/1977 | Garcia |
| 4,086,030 | A | 4/1978 | David |
| 4,190,300 | A | 2/1980 | Scalzi |
| 4,718,824 | A | 1/1988 | Cholet et al. |
| 4,797,075 | A | 1/1989 | Edwards et al. |
| 5,135,059 | A | 8/1992 | Turner et al. |
| 5,392,862 | A | 2/1995 | Swearingen |
| 6,019,583 | A | 2/2000 | Wood |
| 6,183,226 | B1 | 2/2001 | Wood et al. |
| 6,220,350 | B1 | 4/2001 | Brothers et al. |
| 6,712,153 | B2 | 3/2004 | Turley et al. |
| 6,896,063 | B2 | 5/2005 | Chang et al. |

(Continued)

OTHER PUBLICATIONS

"IsolizerTM Centralizer," Halliburton, 2013, 2 pages.
"Navi-Drill Motor Handbook," Ninth Edition, Baker Hughes Incorporated, 2002, 101 pages.
Enenbach, "Straight-Hole Tubodrilling," American Institute of Mining, Metallurgical, and Petroleum Engineers, Inc., SPE 6441, 1977, pp. 123-130.

(Continued)

*Primary Examiner* — Taras P Bemko
(74) *Attorney, Agent, or Firm* — Sheridan Ross P.C.

(57) ABSTRACT

Embodiments of the present invention are generally related to a method and apparatus for subterranean wellbores and in particular, to a method and apparatus for rotating a subsurface tubular string, such as a casing section, without rotation at the surface. More specifically, a casing section of a wellbore may be rotated to provide a cement seal with increased strength and reliability. In one embodiment, a downhole tool and rotation assembly is disclosed which imparts a torsional force to a predetermined casing section when a fluid is flowed through the downhole tool and rotation assembly.

20 Claims, 8 Drawing Sheets

(56) References Cited

U.S. PATENT DOCUMENTS

| | | | | |
|---|---|---|---|---|
| 7,655,096 | B2 | 2/2010 | Walker et al. | |
| 8,425,651 | B2 | 4/2013 | Xu et al. | |
| 8,627,901 | B1 * | 1/2014 | Underwood | E21B 7/14 175/107 |
| 8,777,598 | B2 | 7/2014 | Akbari et al. | |
| 8,991,505 | B2 | 3/2015 | Fleckenstein et al. | |
| 1,028,782 | A1 | 5/2019 | Fleckenstein et al. | |
| 2003/0070841 | A1 | 4/2003 | Merecka et al. | |
| 2005/0145384 | A1 | 7/2005 | Jasser et al. | |
| 2005/0205264 | A1 | 9/2005 | Starr et al. | |
| 2005/0205265 | A1 | 9/2005 | Todd et al. | |
| 2005/0205266 | A1 | 9/2005 | Todd et al. | |
| 2009/0301710 | A1 | 12/2009 | Clem et al. | |
| 2010/0276138 | A1 | 11/2010 | Wittman | |
| 2012/0007364 | A1 | 1/2012 | David | |
| 2013/0175093 | A1 | 7/2013 | Taylor et al. | |
| 2014/0219836 | A1 | 8/2014 | Houst et al. | |
| 2015/0060144 | A1 | 3/2015 | Wang et al. | |

OTHER PUBLICATIONS

Motahhari et al., "Method of Optimizing Motor and Bit Performance for Maximum ROP," Journal of Canadian Petroleum Technology, 2009, vol. 48(6), pp. 1-6.

Seale et al., "Optimizing Turbodrill Designs for Coiled Tubing Applications," Society of Petroleum Engineers, Inc., 2004, pp. 1-10.

Yu et al., "Design and Development of Turbodrill Blade Used in Crystallized Section," The Scientific World Journal, 2014, pp. 1-12.

Official Action for U.S. Appl. No. 14/979,105, dated Mar. 22, 2018, 6 pages (Restriction Requirement).

Official Action for U.S. Appl. No. 14/979,105, dated Jul. 18, 2018, 9 pages.

Official Action for U.S. Appl. No. 14/979,105, dated Oct. 22, 2018, 5 pages (Interview Summary with 892).

Notice of Allowance for U.S. Appl. No. 14/979,105, dated Jan. 3, 2019, 12 pages.

Corrected Notice of Allowance for U.S. Appl. No. 14/979,105, dated Jan. 14, 2019, 5 pages.

* cited by examiner

METHOD AND APPARATUS TO ROTATE SUBSURFACE WELLBORE CASING

CROSS REFERENCE TO RELATED APPLICATIONS

This application is a divisional application of U.S. patent application Ser. No. 14/979,105, filed Dec. 22, 2015, now U.S. Pat. No. 10,287,829, which claims the benefit of U.S. Provisional Patent Application No. 62/095,319, entitled "Method and Apparatus to Rotate Subsurface Wellbore Casing" and filed on Dec. 22, 2014, and to U.S. Provisional Patent Application No. 62/248,084, entitled "Method and Apparatus to Rotate Subsurface Wellbore Casing" filed on Oct. 29, 2015, the entire disclosures of each which are incorporated by reference herein.

FIELD

Embodiments of the present invention are generally related to a method and apparatus for wellbores and in particular, to a method and apparatus for rotating a subsurface drill string such as a casing section without rotation at the surface.

BACKGROUND

It is well known in the oil and gas industry that moving casing during cementing operations provides improved cement jobs to isolate different producing formations, aquifers, etc. Generally, there are two ways to move the casing during cementing, reciprocation and rotation. Both reciprocation and rotation of casing rely upon use of the rig at the surface to rotate or reciprocate the entire casing string, which may be undesirable for operational or safety considerations. The bottom section of casing is the most critical portion, requiring a quality cement job and resultant seal in the annulus between the casing and the borehole. Achieving an improved cement seal in the annulus at the surface casing bottom helps assure a seal and prevents any fluid migration resulting in potential contamination of surface aquifers. Also, improving the seal around the bottom of intermediate casing strings enhances the ability of the cement to prevent annular flow during well control events and prevents communication from multiple producing zones. Finally, improving the seal across the bottom section of the production casing improves the isolation of the productive interval and prevents undesirable water production which can impede and limit hydrocarbon production.

Furthermore, there is a significant need in the oil and gas industry to provide an extended length rotating tool or tubing section at a predetermined location during a workover operation or to drill out a bridge plug. This would allow rotation at the distal end of coiled tubing or a work string by utilizing hydraulic energy and eliminate the need for rotation at the surface. Although it is currently known to use downhole hydraulic motors, these motors have a very limited length and application since only a small portion on the distal end actually rotates.

This disclosure solves these needs, by providing a method and apparatus for rotating a subsurface drill string such as a casing section without rotation at the surface.

SUMMARY

A method and apparatus for rotating a tubular string section, such as a casing section, within a wellbore without surface rotation is disclosed. More specifically, a casing section of a wellbore may be rotated to provide a cement seal with increased strength and reliability between the external surface of the pipe and subterranean formation. A downhole casing device is disclosed which develops and imparts a torsional force to a surrounding casing section when a fluid is flowed through the device.

Several embodiments of the downhole tool are disclosed, to include those comprising internally spiraled geometric shapes, internally bladed or airfoil geometric shapes, statorless turbine designs, reversed rotor/stator designs and modified mud motor positive displacement motor designs.

More specifically, in the statorless turbine embodiment, a rotor essentially forms the outer housing with blades attached, rather than forming the inner shaft. An example of a statorless turbine is a windmill, but here one is turning the outside housing, rather than a shaft. In the reversed rotor/stator design, a traditionally turbine with a stator and a rotor is adapted such that the typical relationship is reversed, that is, the inner "rotor" is held stationary and the outer "stator" is allowed to rotate. As such, the outer rotating housing serves as the rotor and the inner shaft serves as the stator. With regard to the modified mud motor design, the rotor is held stationary, while the stator is allowed to rotate as fluid is pumped through. Such a design is similar to a mud motor, but reversed, essentially creating a reversed Moineau pump. The rotational power and torque achieved is quite substantial (at relatively low RPM), and may generate a forward thrust to either move a tubular string forward or impart a compression force on the bit, independent of the string weight.

In one embodiment, a downhole tool adapted for rotating a tubular string section within a wellbore is disclosed, the downhole tool comprising: a rotatable device body having an interior surface defining a cavity, an exterior surface, an upper end and a lower end, and wherein at least one of the upper end and the lower end are configured to engage the tubular string section; and wherein the interior surface has a geometric configuration to impart a torsional force to the tubular string section when a fluid is pumped through the cavity of the rotatable device body.

In another embodiment, a method for rotating a predetermined tubular string section in a tubular string within a wellbore is disclosed, the method comprising: providing a downhole tool, the downhole tool comprising a rotatable body having an interior surface defining a cavity, an exterior surface, an upper end and a lower end, and wherein at least one of the upper end and the lower end are interconnected to the predetermined tubular string section, and wherein the downhole tool is configured to impart a torsional force to the predetermined tubular string section when a fluid is pumped through the cavity; interconnecting the downhole tool with the predetermined tubular string section; interconnecting a sealed rotation transition element to the tubular string above the downhole tool; pumping a fluid down the tubular string and through the downhole tool; and wherein the rotatable device body transfers the torsional force to the predetermined tubular string section thereby rotating the targeted tubular string section.

In yet another embodiment, a system for rotating a predetermined casing section within a wellbore, the system comprising: a downhole tool having an interior surface defining a cavity, an exterior surface, an upper end and a lower end, wherein the lower end is configured to engage the predetermined casing section; wherein the interior surface has a geometric configuration to impart a torsional force to the downhole tool when a fluid is pumped through the cavity; wherein the downhole tool is configured to transfer the torsional force to the predetermined casing section, thereby rotating the predetermined casing section as the fluid is pumped through the downhole tool. The sealed rotation element may be used for rotation of a bottom section of a tubular string, such as the distal portion of a casing string. However, the invention in the following description also includes rotation of a section of a tubular string which may be disposed between the proximal and the distal portion.

In one embodiment, the interior surface of the downhole tool has a spiraled geometric pattern which imparts a torsional force to the tubular string when a fluid is pumped down the wellbore. In another embodiment, the interior surface of the downhole tool is a drillable material comprised of at least one of a drillable cement, a composite material and a plastic materials to allow selective destruction of the device with a drill string coiled tubing, etc. In one embodiment, the rotating tubular string section is disposed adjacent to a non-rotating tubular string section. In one embodiment, the rotating tubular string section is threadably coupled to threads positioned on the rotatable device body. In one embodiment, the plurality of rotors and the plurality of stators are of an airfoil cross-sectional configuration. In one embodiment, the downhole tool further comprises a plurality of jetted ports emitting at least a portion of the fluid through the exterior surface.

In one embodiment, at least a portion of the interior of the downhole tool comprises a plurality of stators and a plurality of rotors. (See definition of stators and rotors below). In one embodiment, the plurality of rotors are disposed at a first radial distance from an axial centerline of the downhole tool and the plurality of stators are disposed at a second radial distance from the axial centerline of the downhole tool, the first radial distance greater than the second radial distance. In one embodiment, the plurality of rotors do not rotate with the rotating tubular string section, and wherein the plurality of stators do rotate with the tubular string section.

In one embodiment, the downhole tool is disposed in a lower tubular string section and a rotation transition element is positioned at a predetermined height above the downhole tool, wherein the tubular string section below the rotation transition element rotates when the fluid is pumped through the cavity of the downhole tool.

In one embodiment, the downhole tool comprises a positive displacement motor (PDM), based on a Moineau pump design, as the hydraulic device. This embodiment reverses the normal stator—rotor relationship of a PDM, holding the "rotor" stationary, and allowing the "stator" to rotate around the stationary rotor, creating a "Reverse PDM" for rotation of part of the casing, tubing or drilling string.

In one embodiment, the method further comprises pumping a predetermined volume of cement down the casing string to form a seal between the exterior surface of the casing string and the wellbore.

In this disclosure, an apparatus and method are provided to rotate a section of the casing, such as the distal two hundred (200) feet of casing, without the use of surface rotation. Surface rotation is conventionally provided by a rotary table, power swivel, or a top drive on drilling or production rigs. In contrast, rotation of a casing section is accomplished by imparting torque to a tool connected at the bottom of the casing string or within the preferred section of casing to be rotated. This rotation is provided hydraulically by a rotary mechanical device that extracts energy from a fluid flow and converts it into useful work, which causes the section of casing to rotate in response to the pumping of a fluid, such as cement, drilling and completion fluids. This tool may be constructed in a spiraled, bladed and/or airfoil pattern of a drillable cement, composite or plastic and affixed to the outer shell of the apparatus by adhesives or other methods. In another embodiment, the tool is of unitary construction, i.e. the outer housing and inner spiraled (or bladed or airfoil) pattern are generally of one piece. Other embodiments are contemplated, to include any designs which effect rotation as urged by fluid flow. An important distinction between the disclosed device (in any of the various disclosed embodiments) and conventional turbines is the use of fluid flow through the device to cause the outer sleeve to rotate, as opposed to an inner shaft, which in turns causes the attached section of casing to rotate.

The disclosure may be used in any portion of a tubular string or drill string in addition to a casing section. That is, the downhole tool may be used to rotate a portion of a drill string that is not a casing string. For example, the downhole tool may be used in workover rig operations. In a workover rig application, a clean out tool is used with a work string rather than a casing string. In another application, the downhole tool may be used in coiled tubing operations. For example, the downhole tool may be used to extend the reach of coiled tubing at the end of a lateral to drill out bridge plugs, wherein the unaided coiled tube may otherwise not reach. The rotation provided by the downhole tool may assist in advancing the coiled tubing to the end of the lateral. Furthermore, the disclosure may be used to rotate a section of a tubular string so as to provide casing cleaning.

Some of the advantages of the disclosed device and method provided herein include an improved cement seal at the bottom of surface casing thereby further protecting aquifers, while allowing the efficiency of landing the casing before the cement job. As wells get deeper and more tortuous as a result of high hole angles, the need to rotate a bottom section of casing to improve cementing increases (such as operations in the Macondo Prospect) just as the ability to rotate from the top decreases. This may be particularly true in subsea wells. The device may be used to rotate a section of the casing to reduce the friction between the casing and the wellbore, improving the ability to run casing strings in more tortuous and extended reach wellbores. The rotation of sections of a tubular string may also allow transfer of hydraulic power from the casing string to propel tubular strings in and out of wellbores, and provide a source of power for tools to provide compression to drill bits, independent of the tubular string weight. The device and method may also be used to provide rotation of sections of tubular strings and cleanout devices on workover rigs, which typically do not have a means of rotation at the surface, and provide assistance with cleanouts by replacing a mud motor. Beyond cementing operations, the rotation provided by the downhole tool may assist in overcoming friction and enable the tubular string to be run in directional configurations currently not possible. Lastly, the disclosed device and method may be used to clean the casing surface of scale and other materials, such as asphaltenes, which can also improve the ultimate quality cement job because the downhole tool provides very high rotational speeds that are much higher than possible with conventional surface rotation systems.

The term "wellbore" and variations thereof, as used herein, refers to a hole drilled into the earth's surface to explore or extract natural materials to include water, gas and oil. The invention can also be utilized for injection wells.

The term "casing" and variations thereof, as used herein, refers to large diameter pipe that is assembled and inserted into a wellbore and typically secured in place to the surrounding formation with cement. The casing may be made of metal, plastic and other materials known in the art.

The term "casing string" and variations thereof, as used herein, refers to assembled lengths of casing with various tools, like centralizers and floats, and may include liners, which are casing strings that do not originate at the surface of the wellbore.

The term "tubular string" and variations thereof, as used herein, refers to an assembled length of pipe, to include jointed pipe and integral tubular members such as coiled tubing, and which generally is positioned within the casing.

The term "drillpipe" and variations thereof, as used herein, refers to the tubular steel conduit fitted with threaded ends and typically used for drilling.

The term "drillstring" and variations thereof, as used herein, refers to the combination of the drillpipe, the bottomhole assembly and any other tools used to make a drill bit turn at the bottom of the wellbore.

The term "float value", "casing float valve", and "float collar" and variations thereof, as used herein, refers to valves that allows flow in one direction (typically down the tubular string) but not the other, to include autofill floats and ball floats The term "fluid" means a substance that continually deforms or flows under an applied shear stress and includes liquids such as water and gases such as air.

The term "reciprocate" means to alternately raise and lower a section of the drillstring or casing string within a wellbore.

The term "rotate" means to turn or rotate a section of the tubular string, drillstring or casing string within a wellbore.

The term "frangible material" and variations thereof, as used herein, refers to any material tending to break into fragments when a force is applied thereto, to include cement, plastic, composite or other similar drillable material.

The term "stator" and variations thereof, as used herein, refers to the traditionally stationary part of a rotor or turbine system and functions to redirect fluid flow. (Note that in some embodiments of this disclosure, the function and/or characteristics of the stator and the rotor are reversed, e.g. the stator is a rotating element and the rotor is a stationary element.)

The term "rotor" and variations thereof, as used herein, refers to the traditionally rotating part of a rotor or turbine system and functions to rotate an interconnected axial element. (Note that in some embodiments of this disclosure, the function and/or characteristics of the stator and the rotor are reversed, e.g. the stator is a rotating element and the rotor is a stationary element.)

This Summary is neither intended nor should it be construed as being representative of the full extent and scope of the present disclosure. The present disclosure is set forth in various levels of detail in the Summary as well as in the attached drawings and the Detailed Description of the Invention, and no limitation as to the scope of the present disclosure is intended by either the inclusion or non-inclusion of elements, components, etc. in this Summary of the Invention. Additional aspects of the present disclosure will become more readily apparent from the Detailed Description, particularly when taken together with the drawings.

The above-described benefits, embodiments, and/or characterizations are not necessarily complete or exhaustive, and in particular, as to the patentable subject matter disclosed herein. Other benefits, embodiments, and/or characterizations of the present disclosure are possible utilizing, alone or in combination, as set forth above and/or described in the accompanying figures and/or in the description herein below. However, the Detailed Description of the Invention, the drawing figures, and the exemplary claim set forth herein, taken in conjunction with this Summary of the Invention, define the invention.

BRIEF DESCRIPTION OF THE DRAWINGS

The accompanying drawings, which are incorporated in and constitute a part of the specification, illustrate embodiments of the invention and together with the general description of the invention given above, and the detailed description of the drawings given below, serve to explain the principals of this invention.

Figure 1:
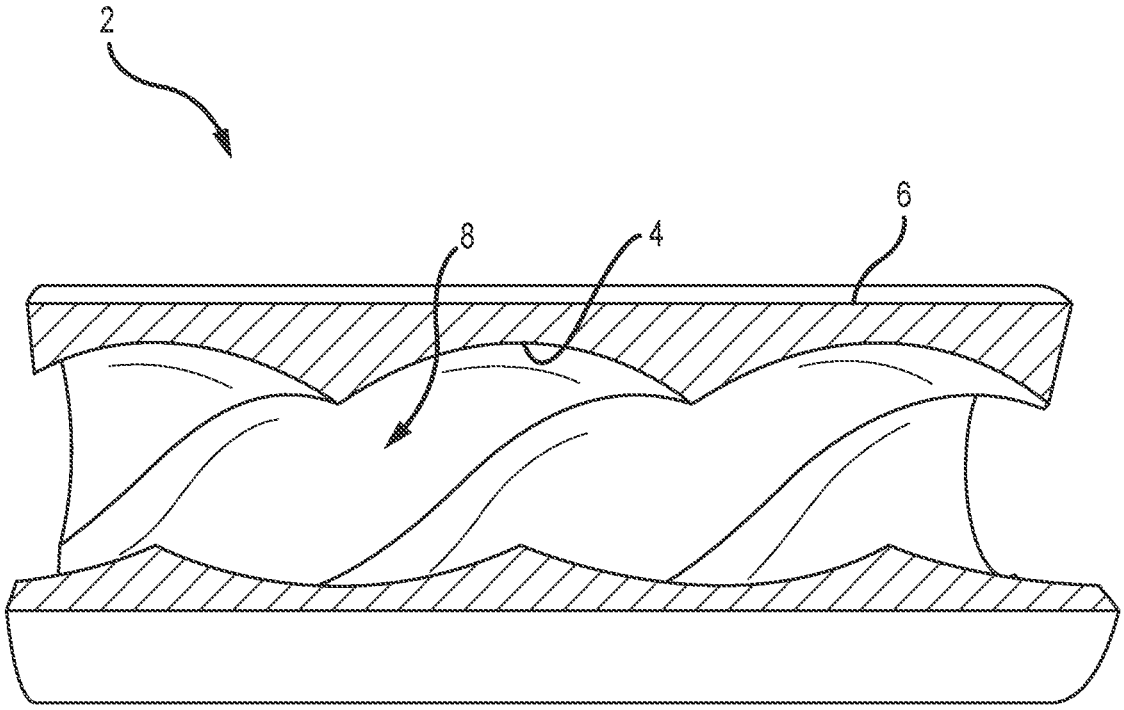
FIG. 1 depicts a side elevation sectional view of a downhole casing device tool according to one embodiment of the invention.

It should be understood that the drawings are not necessarily to scale. In certain instances, details that are not necessary for an understanding of the invention or that render other details difficult to perceive may have been omitted. It should be understood, of course, that the invention is not necessarily limited to the particular embodiments illustrated herein.

To assist in the understanding of the present invention the following list of components and associated numbering found in the drawings is provided herein:

| # | Component |
|---|---|
| 2 | Downhole tool |
| 3 | Tool shaft |
| 4 | Interior surface |
| 5 | Tool blades |
| 6 | Exterior surface |
| 7 | Tool rotor |
| 8 | Cavity |
| 9 | Tool stator |
| 10 | Wellbore |
| 12 | Non-rotating casing |
| 14 | Rotating casing section |
| 16 | Float collar |
| 18 | Sealed rotation element |
| 20 | Cement plug |
| 22 | Connection |
| 24 | Casing shoe |
| 26 | Centralizer |
| 28 | Casing downhole end |
| 30 | Wellbore |
| 32 | Casing interior |
| 34 | Casing cement flow |
| 36 | Downhole tool interior flow |
| 38 | Annulus cement flow |

-continued

| # | Component |
|---|---|
| 40 | Centralizer rotation |
| 42 | Downhole tool rotation |
| 44 | Jetted ports |
| 46 | Jetted ports emission |
| 50 | Turbine |
| 51 | Fluid flow |
| 52 | Turbine first stage |
| 54 | Turbine second stage |
| 56 | Stator blades |
| 58 | Rotor blades |
| 60 | Turbine rotation |
| 62 | Turbine shaft |

DETAILED DESCRIPTION

The downhole casing device (aka "rotary device" or "downhole tool") and method of use will be described with respect to FIGS. 1-8. FIG. 1 depicts a side elevation sectional view of the cylindrically-shaped downhole casing device or tool 2, comprising an interior aperture or cavity 8, an exterior surface 6 and an interior surface 4. The interior surface 4 defines the cavity 8. The interior surface is configured to rotate, twist, and generate a torsional force (with respect to the downhole casing) on the downhole tool when fluid is flowed through the cavity 8. In the embodiment of FIG. 1, the interior surface 4 forms a spiraled pattern. In other embodiments, the interior forms other patterns that generate a rotational, twisting or torsional force, to include blades or airfoils (such as a statorless turbine, or a rotor and stator combination turbine) fitted in radial patterns within the cavity and similar adaptations of axial compressors. The cylindrically-shaped downhole casing device 2 comprises an external diameter (which may have a separate tubular outer member as part of the tool) which fits within a casing string which is lowered into a wellbore and cemented in place to prevent the wellbore from collapsing, and to isolate various subterranean formations. Note that in some embodiments, the downhole tool attaches or interconnects to an existing casing joint. In other embodiments, an outer housing may be part of the tool, which may threadingly connected to the rest of the tubular or casing string or may have a sealed rotation device on one or both ends, to allow independent rotation. Furthermore, the downhole tool may be attached or interconnected to an outer housing different than the casing joint.

The downhole casing device 2 may be constructed such that the interior portion is of a spiraled (and/or bladed to include an airfoil shape) pattern of a drillable cement, composite or plastic and affixed to an outer shell portion by adhesives or other methods, such as those used to affix a drillable inner portion of float equipment to an outer housing. In another embodiment, the tool is of unitary construction, i.e. the outer housing and inner spiraled (and/or bladed) pattern are of one piece.

Figure 2:
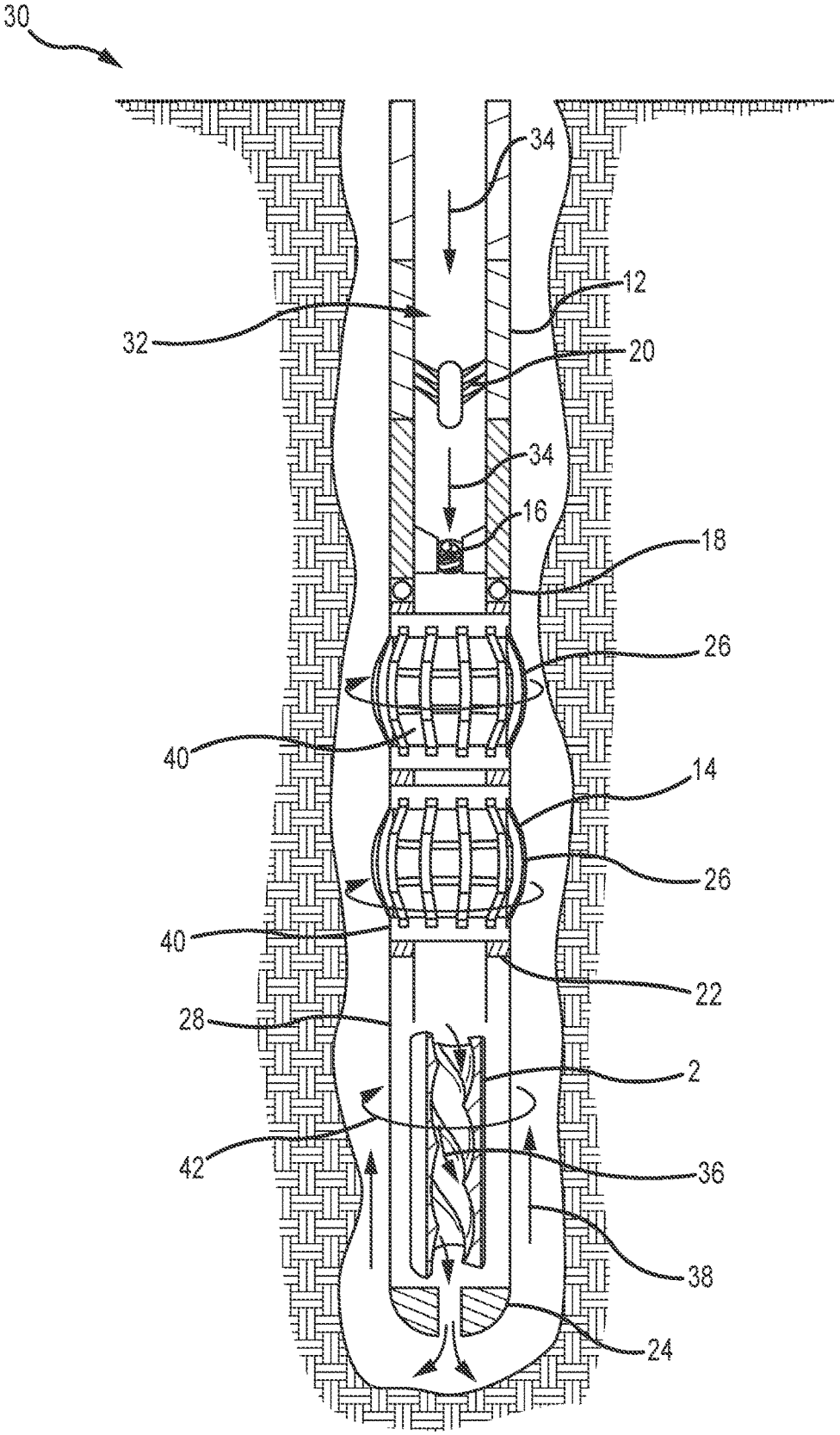
FIG. 2 is a detailed side elevation sectional view of the downhole casing device tool of FIG. 1 with additional wellbore components according to one embodiment of the invention.

FIG. 2 is a detailed side elevation sectional view of the downhole casing device 2 of FIG. 1 with additional wellbore components. The downhole casing device 2 may be threadedly connected, welded, or otherwise connected to other tubular members of a tubular string, typically a casing string, which may consist of jointed pipe, or an integral tubular, such as coiled tubing. The downhole casing device 2 may be placed anywhere in the tubular string within a wellbore 30.

In a preferred embodiment as provided in FIG. 2, a sealed rotation element 18 (which demarcates the non-rotating casing section 12 from the rotating casing section 14) is positioned at or below the casing cementing collar, and the rotatable downhole casing device 2 is positioned above the casing shoe 24 or the bottom of the tubular string 28. The bottom tubular section 28 is rotated (along with the downhole tool 2 in a downhole tool direction 42) during a process commonly called "a primary cement job," wherein the cement travels in a downtown tool interior flow 36 downward direction and returns in an upward direction of annulus cement flow 38.) The rotation of the bottom section of casing 14 would enhance the coverage throughout the entire annular area of liquid cement and would be beneficial in removing any cement voids created by drilling mud pockets and creating uniform cement coverage between the exterior surface of the casing and the wellbore 30. The rotation could be aided by use of one or more casing centralizers 26, which are designed to enhance rotation. Casing centralizers 26 are known in the art, and typically used to centralize lengths of casings or liner strings within the wellbore 30. At the end of a primary cementing process, the downhole casing device 2 is surrounded with liquid cement in both the annulus of the tubular string and throughout its interior below the float collar 16. Per customary methods during a primary casing or liner cement job, the liquid cement is allowed to set and harden around the casing in the annulus by maintaining the casing and cement in a static position. When enough time has elapsed, the bottom of the casing may be drilled out (to include drilling through the interior of the downhole casing device if not drilling through the entire downhole casing device) with conventional drilling tools, and the well construction process continued or ultimately completed to allow production. The afore-mentioned cement waiting time is normally called the Waiting on Cement ("WOC") time, which may be judged as sufficient by the time it takes for the cement to reach 500-1000 psi compressive strength.

After the cement has cured, the bottom portion of the casing string may be drilled out, including the claimed invention device 2 and any other cementing equipment placed in the casing string, such as cementing plugs 20, float collar 16 and float shoe 24. During this process, the interior of the invention device 2 may also be drilled out.

It will be appreciated by one of skill in the art that the placement of the rotatable downhole casing device in the position depicted in FIG. 2 may shield the device from the higher differential pressure across the cement plugs customarily observed at the end of pumping a primary cement job, a process commonly called "bumping the plug". Furthermore, the placement of the rotatable downhole casing device 2 at or below the position depicted in FIG. 2, relative to the placement of the float collar 16, results in a substantially identical pressure exerted on the inside and exterior of the device, and will be a function of the hydrostatic pressure of the cement.

The downhole casing device would typically be used in coordination with other tools. For example, to allow a targeted section of casing to rotate without rotating the entire casing string, a sealed rotation element 18 (or elements) is needed. The afore-mentioned sealed rotation element 18 of FIG. 2 serves such a purpose, i.e. decouples the rotation of the targeted casing section from other (static) casing sections. Sealed rotation elements are generally known in the art for other applications, and could be accomplished in a similar manner to sealed rotation elements disclosed in, for example, rotating liner hangers, such as those described in U.S. Pat. Nos. 4,033,640 and 4,190,300, both of which are incorporated herein by reference in entirety.

The downhole casing device 2 could be used for downhole operations other than cementing, such as wellbore cleaning, or any operation where it is desired to rotate a targeted section of a tubular string. For example, the downhole casing device 2 may be used to rotate the bottom of a tubular string without the use of a mud motor or other conventional means of downhole rotation. Another example would be the use of downhole casing device 2 at multiple points in a tubular string with brushes or other interior casing surface cleaning devices attached to the outside of the downhole casing device 2, to clean the interior surface of the casing. The downhole casing device 2 may also be used if the flow is reversed, with fluid pumped down the tubular string annulus and up the inside of the tubular string. Note that such reverse circulation is frequently used because of the higher velocities possible in the reduced diameter of a tubular string, which may help to remove cuttings and debris.

Figure 3:
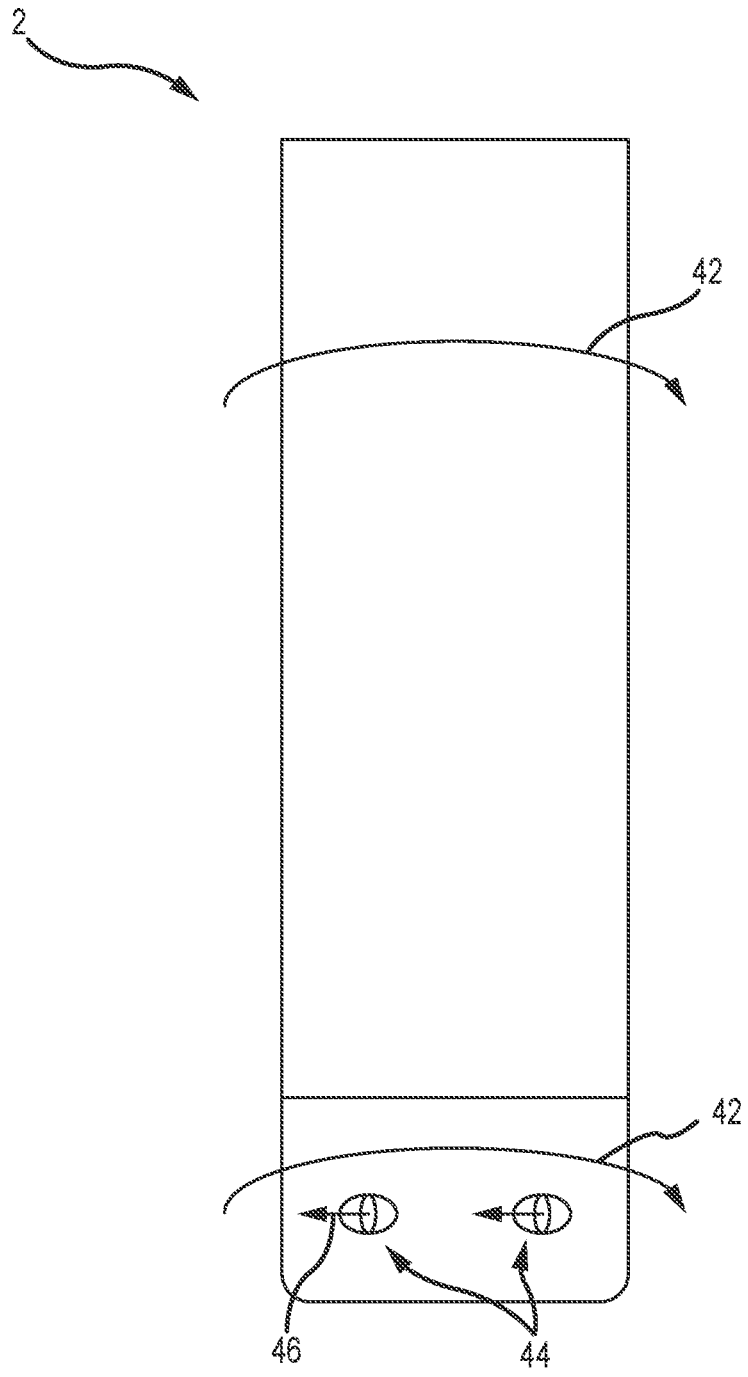
FIG. 3 depicts a side elevation view of a downhole casing device with jetted port feature according to another embodiment of the invention.

FIG. 3 depicts a side elevation view of a downhole casing device 2 with jetted port feature. The jetted ports 44 assist with cement placement and create a torque to increase casing rotation. Multiple jetted ports 44 can be placed within the casing string. These ports 44 are angled perpendicular to the casing axis and generally point in the same direction. The ports 44 emit fluid as jetted ports emission 46. The jetted feature of the ports provides increased force and thereby imparts a torque into the casing string from the pumping action of the cement. The jetted ports may be placed within the casing string as needed with appropriate diversion inside the casing. The ports 44 may be places at regular radial distances about the circumference of the tool 2, e.g. every 10 degrees, or every 180 degrees, or any value between 5 degrees and 180 degrees. The ports 44 may be disposed to form a symmetrical arrangement about a circumference of the tool 2, e.g. at 0 and 180 degrees, or at 0, 90, 180, and 270 degrees. The tool 2 rotates in an opposite direction from the emission direction, i.e. as downhole tool rotation 42.

The jetting action, along with rotation, also gives a more uniform 360 degree pattern for the cement to flow around and up the annulus of the casing/open hole interval. Furthermore, the sweeping action can fill the annulus with cement more uniformly. The ports may be distributed anywhere within the casing, even if rotation is not possible. Ball sealers, plugs, and/or sliding sleeves or other shut off mechanisms may be used to divert the cement or fluid flow as needed for effective coverage. Non cementing applications include wellbore cleaning or stimulation by acidizing, for example.

Figure 4:
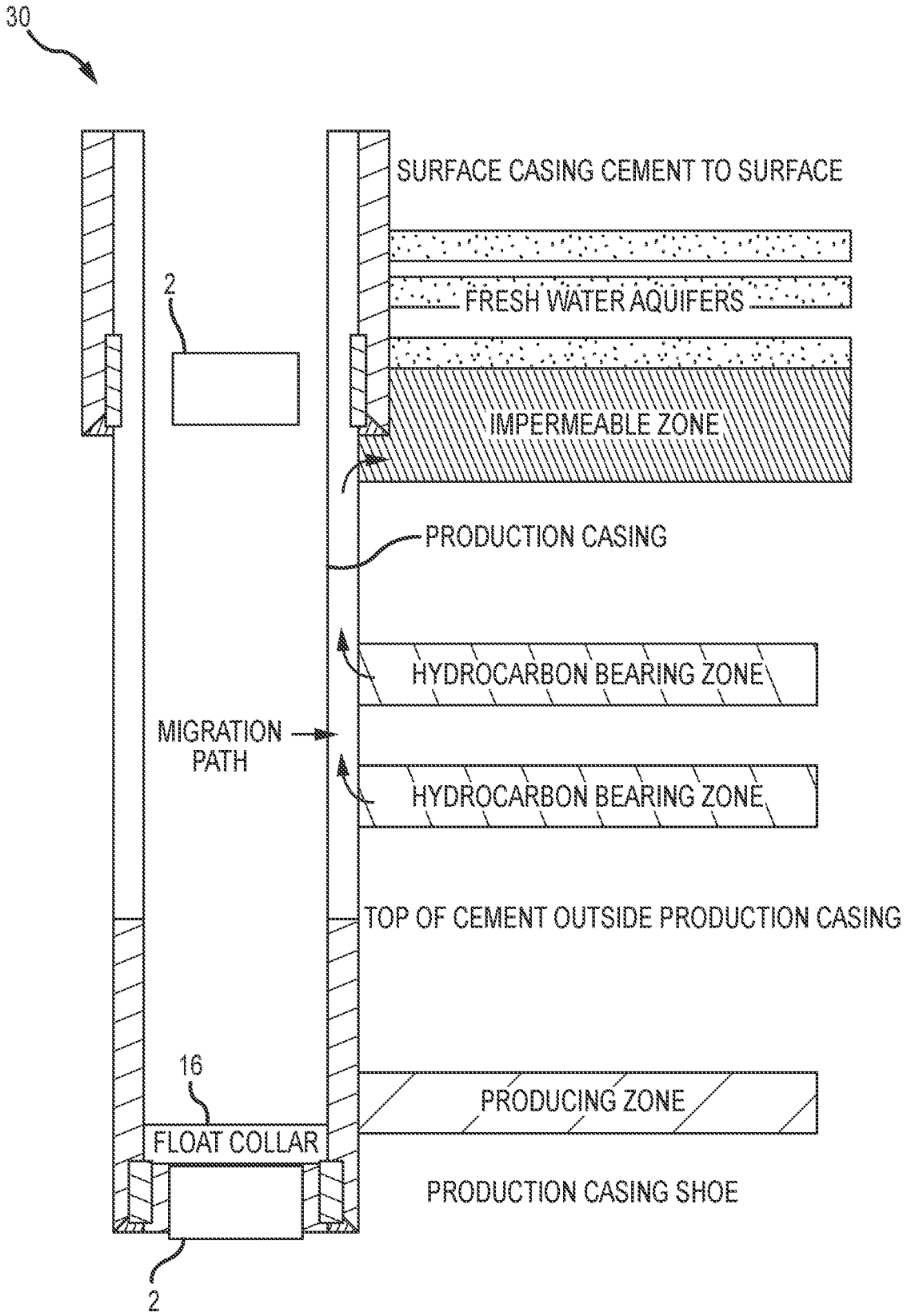
FIG. 4 depicts a front elevation sectional view of a wellbore with two positions identified for a downhole casing device.

FIG. 4 depicts a front elevation sectional view of a wellbore 30 with a downhole casing device tool 2 positioned near the cement or casing shoe of a casing string, and another positioned near a casing shoe of a previously cemented casing string, such as the surface casing. In one embodiment, it is advantageous to place the invention within ten (10) feet of the cement shoe because such a position will enhance the set cement hydraulic seal around the casing, and protect the formations above, such as fresh water aquifers, from migration of fluid in the casing annulus.

The downhole casing device 2 may be manufactured in a similar manner to stators for mud motors or progressive cavity pumps as described in U.S. Pat. No. 8,777,598, with the exception that the material forming the spiraled inner member of the rotary device can be made of a rigid material, such as a hard plastic, composite or cement, that does not need to deform as does a conventional stator. Instead, it is desirable that the inner member be easily drillable yet not deformable. The downhole casing device 2 could also be manufactured by injection molding of plastics, resins or composite materials, either in the tool or externally and then fastened to the outer housing by adhesives, set screws or other methods well known to one of skill in the art. U.S. Pat. No. 8,777,598 is incorporated herein by reference in its entirety. All or a portion of the downhole tool may be manufactured using 3-d printing, or any manufacturing process known to those skilled in the art.

Alternatively or additionally, the downhole casing device 2 could be manufactured using techniques disclosed in the turbo pump of U.S. Pat. No. 4,086,030, but using the general concept to rotate the outer housing to rotate the casing section in response to fluid movement being pumped through, as opposed to imparting force to the fluid by the pump rotation. U.S. Pat. No. 4,086,030 is incorporated herein by reference in its entirety.

In another embodiment, the downhole casing device 2 employs a rotor and stator in a similar configuration to those know in the art as "turbodrills", but reverses the conventional relationship between an outer stator and inner rotor by having an inner stator with a set of static (stationary) inlet guide vanes that direct the fluid flow onto the rotating rotor blades affixed to the outer housing. (A conventional stator/rotor arrangement is shown in each of FIGS. 5 and 6.) The inner stator/outer rotor arrangement causes the outer housing (as interconnected to the rotor) to rotate in relation to the inner stator.

Figure 5:
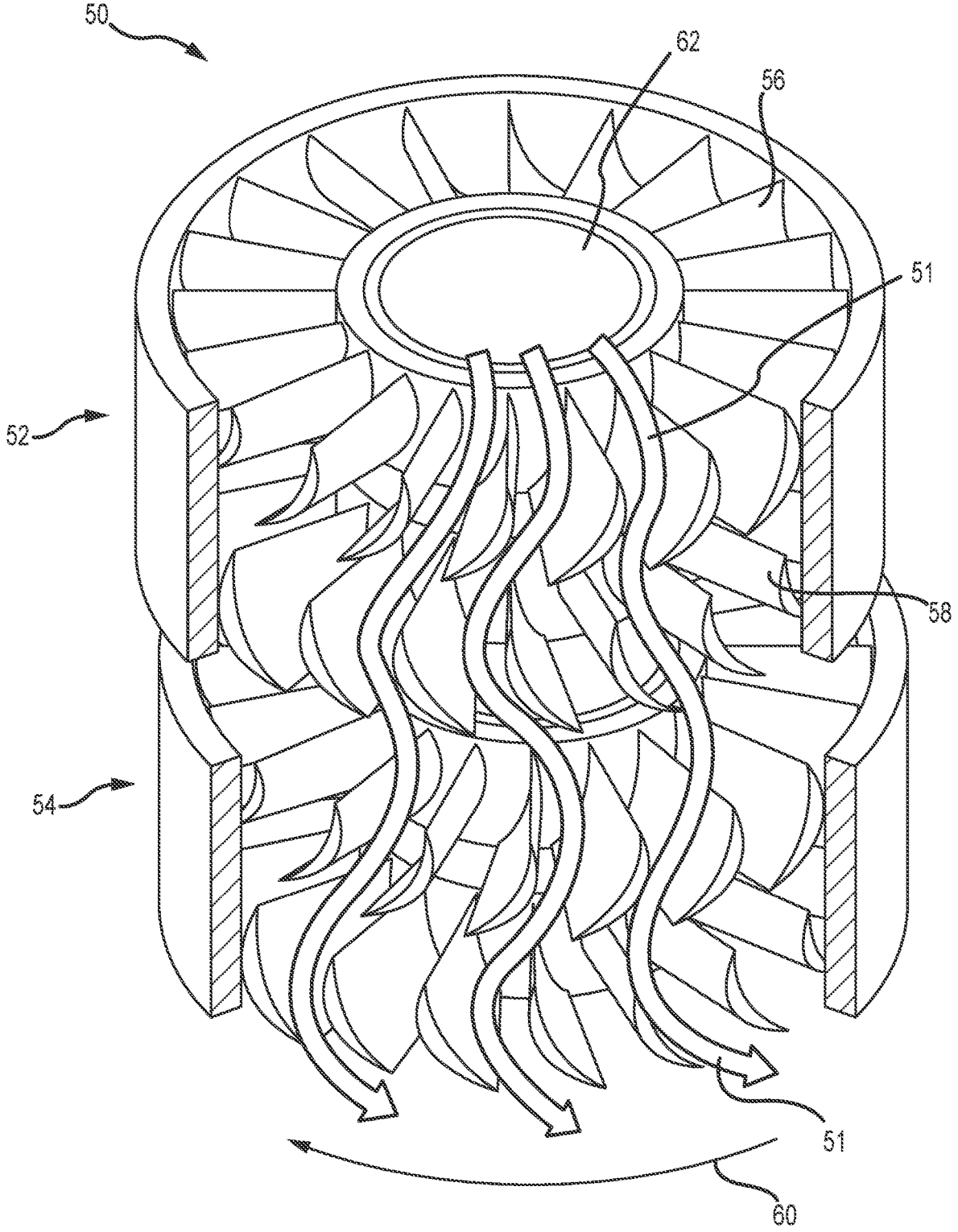
FIG. 5 depicts a two-stage turbine.
Figure 6:
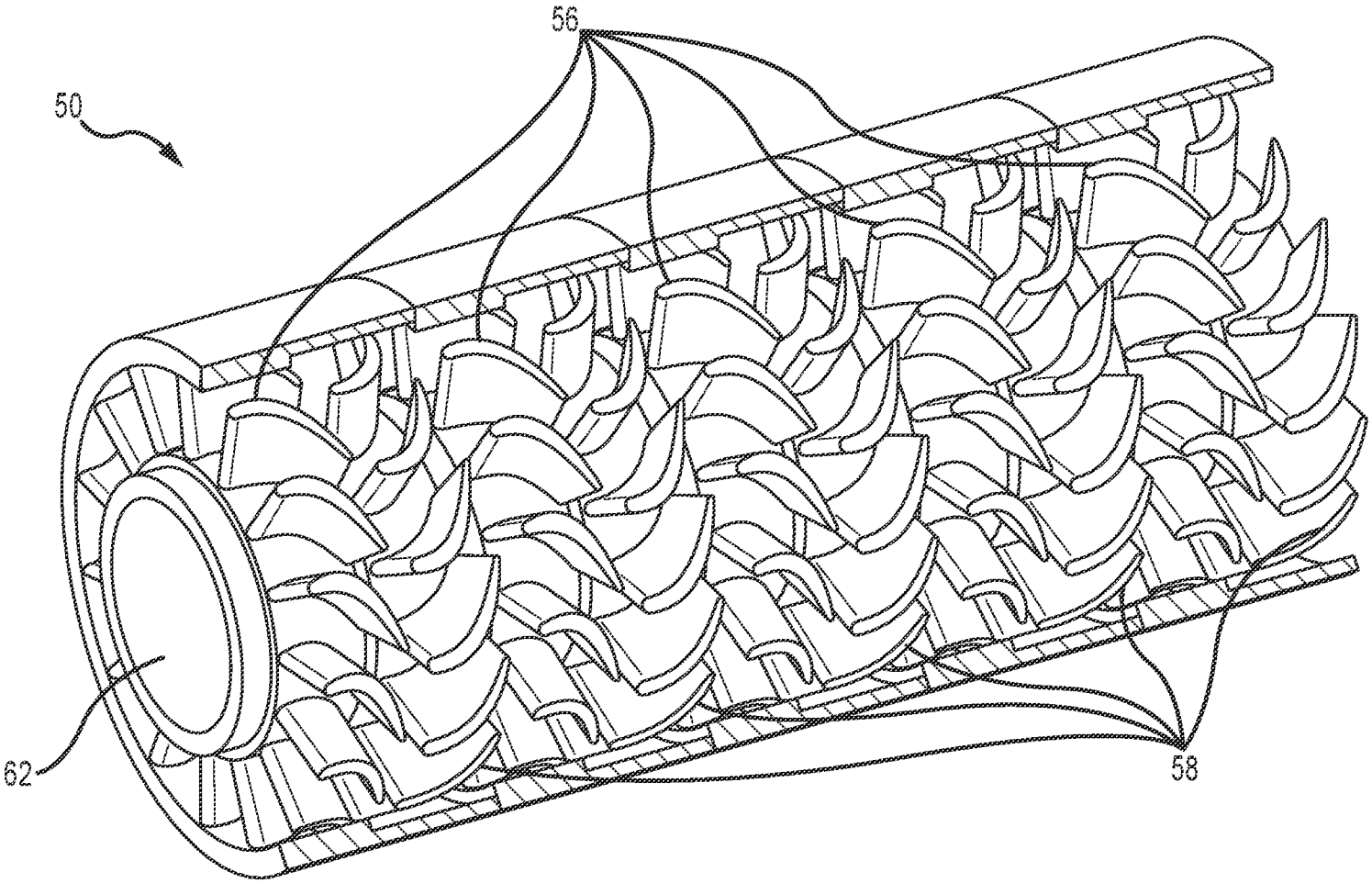
FIG. 6 depicts a multi-stage turbine.

In the conventional relationship between an outer stator and inner rotor in a turbine 50 as provided in FIG. 5, a fluid, depicted as fluid flow 51, axially enters first stage turbine 52 in primarily a downward direction, that is, of a vector without horizontal component. The entering fluid is then directed by stators 56 to include a horizontal component, that is, the entering fluid is angled away from purely vertical. The stationary stator blades 56 are rigidly attached to the stationary outer cylinder surrounding the shaft 62 of the turbine 50. The fluid leaving the stator blades 56, in the first stage 52, then encounters the rotor blades 58 of the first stage 52. The rotor blades 58 are rigidly attached to the shaft 62 of the turbine. As the fluid passes the rotors 58, a lifting force is imparted to the rotors 58 (akin to the lift generated by fluid passing over and under an airfoil), so as to rotate the shaft 62. The fluid then repeats the process for subsequent turbine stages, i.e. fluid leaving first stage rotors 52 encounters second stage 54 stators so as to be re-directed to second stage rotors, wherein additional lifting force is generated and additional rotational energy is imparted to the turbine shaft 62 thereby causing turbine rotation 60.

In contrast, in the above "statorless turbine" downhole casing device 2 embodiment of FIG. 1, the fluid flow exiting an upstream rotor impinges onto a downstream rotor without an intermediate set of stator vanes (that rearrange the pressure/velocity energy levels of the flow) being encountered. Such a "statorless turbine" downhole casing device 2 embodiment overcomes the need for tightly spaced stages in a downhole turbine by using the length of the shoe track below the cement float collar, typically 40-80 feet, thereby allowing the flow between stages to revert to an essentially axial flow path before entering the next stage.

Returning to the downhole casing device 2 embodiment comprising stators and rotors, a variety of shapes and combinations of turbine designs (and associated stator and/or rotor designs) may be used to rotate the casing or drilling string. The turbines may be given a variety of shapes and designs to increase the torque or speed; generally, longer pitches to the blades typically result in a lower rotational velocity but greater torque, and shorter pitches typically result in faster rotational speeds, but less torque. The shape of the blade is designed to use similar principals to airfoil or wing design, with the airfoil shape to provide a "lift" for the blade, with a varying blade angle decreasing from the blade center to the blade tip.

With respect to a downhole casing device embodiment with both stators and rotors, the interconnections of each are reversed from conventional arrangements. That is, the inner stators are affixed to the non-rotating ends of the apparatus that the outer rotor, affixed to the housing, rotates about. Stated another way, the traditional relationship between a turbine rotor and a turbine stator are reversed such that the rotating blades are on the outer rotating housing (rotor) and the non-rotating blades are arrayed on the inner, non-rotating shaft (stator). As mentioned, a conventional stator/rotor arrangement is shown in each of FIGS. 5 and 6.

The design of downhole turbines with rotating shafts is well known in the art and for instance, is accomplished by using the design and geometry of blades pictured in U.S. Pat. Appl. No. 2015/0060144 to Wang, entitled "Turbine Blade for Turbodrills," published Mar. 5, 2015 ("Wang"). Wang is incorporated by reference in entirety. Additionally, the design of blades used in the rotor and stator are further described in Yu et al "Design and Development of Turbodrill Blade Used in Crystallized Section," The Scientific World Journal, China University of Geosciences, Beijing, China, Sep. 2, 2014 ("Yu"). Yu is incorporated by reference in entirety.

The embodiments of the downhole casing device comprising stators and rotors are particularly useful to place multiple downhole casing device tools 2 at several locations along the casing or liner to be rotated. Such implementations would allow longer liners to be rotated, either during operations to run the casing in place or during operations to cement the well. Such downhole casing device tools 2 may be drilled out, removed mechanically, or be affixed to an outer tubular body with shear screws or similar to allow the cementing plugs to remove the inner turbine of the tool. Such an approach would propel the loose inner portion of the tool to the distal end of the liner, landing at the customary casing landing collar.

In one embodiment, a low friction centralizer 26 may be affixed to the outside of the downhole tool 2 to reduce friction. A low friction centralizer, such as that disclosed with roller balls in U.S. Pat. Publ. No. 2010/0276138 (herein incorporated by reference in entirety), may be used. Furthermore, low friction centralizers comprising materials of low coefficients of friction, such as materials used in composite and plastic rod guides, may also be employed with the downhole casing device so as to further reduce wellbore friction. Coupling or pairing of such low friction elements may be provided in any of the disclosed embodiments of the downhole casing device, to include the statorless turbine downhole casing device embodiments and the downhole casing device embodiments comprising stators and rotors.

Figure 7A:
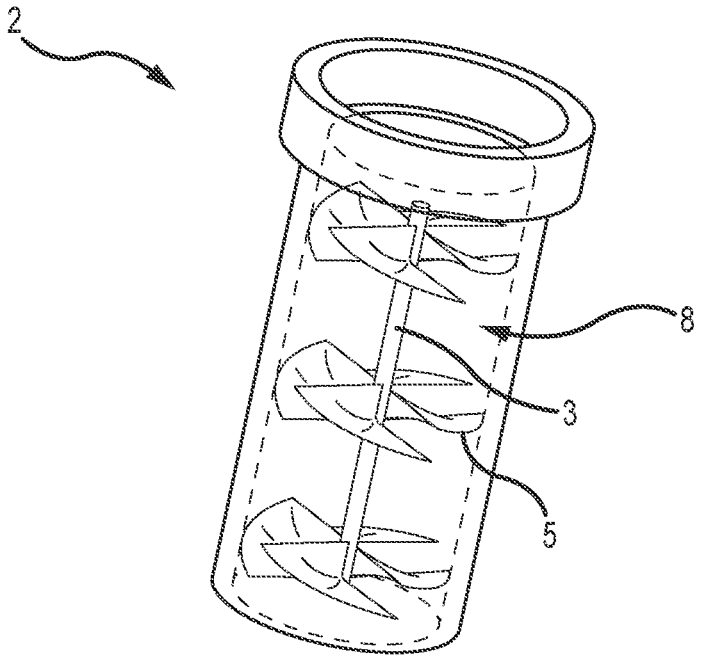
FIG. 7*a* depicts a perspective view of the downhole casing device according to another embodiment of the invention.
Figure 7B:
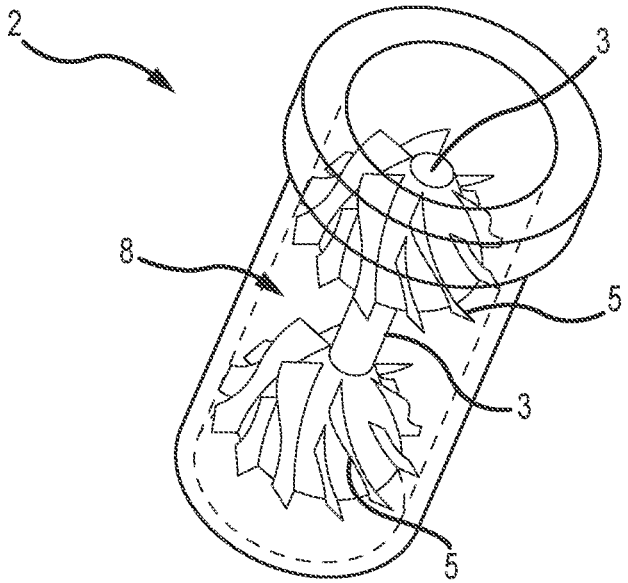
FIG. 7*b* depicts another perspective view of the downhole casing device according to the embodiment of the invention depicted in FIG. 6*a*.

Another embodiment of the downhole casing device 2 is depicted in FIGS. 7*a-b*. The embodiment of the downhole casing device 2 of FIGS. 7*a-b* is an example of a statorless turbine, in which the tool blades 5 (acting as rotors) are affixed to the outer housing, after being placed in the outer housing by means of a non-rotating central shaft 3 (in relation to the outer housing). In this embodiment, the entire assembly would rotate in response to fluid flow through the tool, rotating the casing or tubing connected to the tool 2. To allow the section of casing to rotate, without rotating the entire casing string, a sealed rotation element (or elements) is needed to decouple the rotation of the casing section from the other section or sections of casing which do not rotate. Such a construction of a sealed rotation element is well known in the art and may be accomplished in a similar manner to sealed rotation elements disclosed in rotating liner hangers, such as described in U.S. Pat. Nos. 4,033,640 and 4,190,300 (both of which are herein incorporated by reference in their entireties), or many other methods known in the art.

It is noted that, as with the above-disclosed embodiments of the downhole casing device 2, the embodiment of FIGS. 7*a-b* may be used for other downhole operations than cementing, such as wellbore cleaning, or other operations where it is desired to rotate a section of the tubular string, such as the bottom of a tubular string, without the use of a mud motor, or other conventional means of downhole rotation. Generally, the rotation of the casing will allow for dynamic friction to dominate and minimize, if not eliminate, static friction during casing running operations. This will also reduce the axial friction resisting the movement of the casing in the wellbore to allow the casing to reach out further into the borehole making longer laterals feasible.

Figure 8:
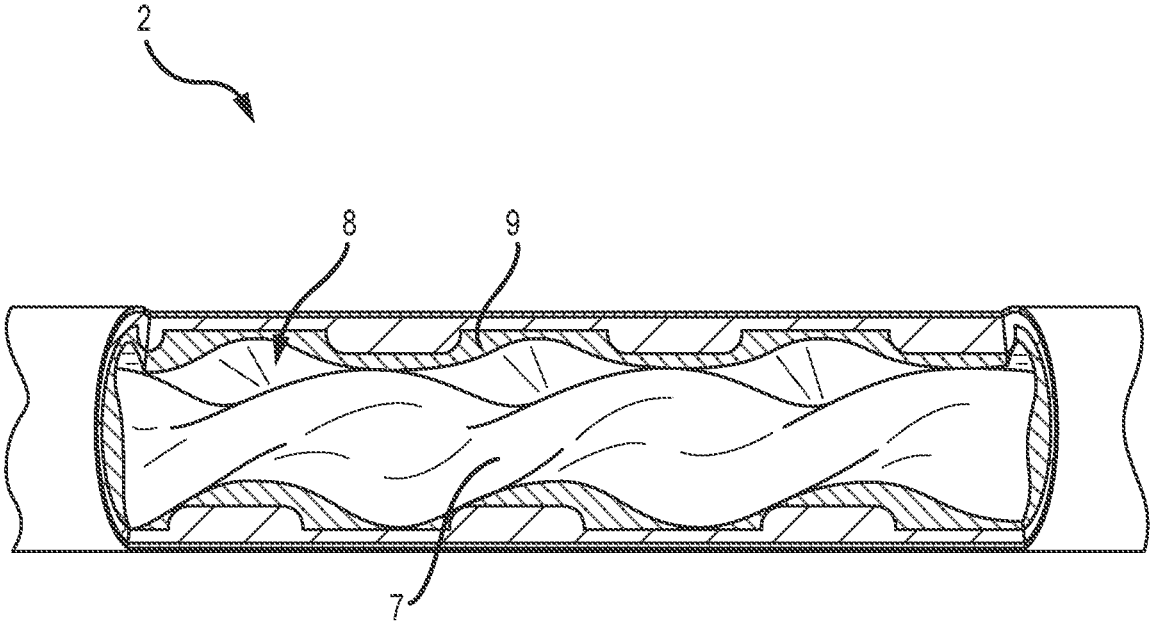
FIG. 8 depicts a Moineau positive displacement motor.

In one embodiment, as provided in FIG. 8, the downhole tool 2 comprises a positive displacement motor (PDM), based on a Moineau pump design, as the hydraulic device. This embodiment reverses the normal stator—rotor relationship of a PDM, holding the "rotor" 7 stationary, and allowing the "stator" 9 to rotate around the stationary rotor, creating a "Reverse PDM" for rotation of part of the casing, tubing or drilling string. Tool rotor 7 and tool stator 9 are disposed within tool cavity 8. Examples of pumps of this type are commonly known as Moineau pumps or progressive cavity pumps and may be found in U.S. Pat. Nos. 2,085,115; 4,797,075; 4,718,824; and 3,753,628, each of which are incorporated by reference in entirety. Examples of PDM's for downhole motors may be found in patents such as U.S. Pat. No. 5,135,059 (incorporated by reference in entirety), and many disclosures, such as the *Navi-Drill Motor Handbook*, Ninth Edition, December, 2002 (incorporated by reference in entirety).

Generally, a Moineau pump with a rotating outer member is found in U.S. Pat. No. 3,932,072 of Clark (incorporated by reference in entirety) which teaches the concept of a Moineau pump, but not for oil well pumping purposes, in which the outer tubing and normally stator portion of the pump is rotated relative to a fixed rotor. U.S. Pat. No. 6,019,583 to Wood (incorporated by reference in entirety) discloses a reverse Moineau motor, and is incorporated by reference in entirety.

More specifically, regarding the Reverse PDM embodiment of the tool 2, this embodiment reverses the normal stator—rotor relationship of a PDM, holding the "rotor" stationary, and allowing the "stator" to rotate around the stationary rotor, creating a reverse PDM for rotation of part of the casing, tubing or drilling string. This configuration allows the section of tubing, casing or drill string to rotate, without rotating the entire casing, tubing or drill string (as disclosed in previous embodiments), but with greater torque, particularly at lower rotational speeds. The reverse PDM may have an inner "rotor" secured on each end to the non-rotational portion of the PDM, allowing the outer "stator" to rotate in response to the fluid pumped through the apparatus. A sealed rotation element may be employed to decouple the rotation of the outer portion or "stator" around the stationary "rotor" which would be secured to the end of the tool holding the rotor, in the fixed position of the tool. FIG. 8 depicts a typical Moineau PDM. In the Reverse PDM embodiment, the metallic central "rotor" pictured would be held stationary, and the "stator" would rotate around the "rotor."

The rotation of the "stator" would allow a much more powerful rotation to be imparted to the casing section. In general, more torque will be output by devices employing greater numbers of lobes. The output torque is roughly proportional to the difference in pressure across the tool. The torque may be limited by the mechanical properties of the elastomer used in construction of the "stator". This material must be rigid enough to withstand abrasion and wear caused by solids in the drilling fluid but, at the same time, be sufficiently flexible to provide a pressure seal between the rotor and the stator. The rotation of a casing section could also result from the use of a conventional mud motor, placed in the casing string to rotate a section. The use of the PDM described above is particularly useful to place multiple tools based on the disclosed invention in series.

Another embodiment of the downhole casing device 2 comprises outer spiraling, designed to provide thrust for the casing and to provide an axial force on the casing to push the casing to the distal portion of the wellbore. Such a forward motion "wellbore tractor" downhole casing device embodiment would be similar to those of experimental tractors that employ screw designs to propel the tractor forward in areas of heavy mud. This may be accomplished with any of the disclosed downhole casing device embodiments, to include the statorless turbine downhole casing device embodiments and the downhole casing device embodiments comprising stators and rotors. A variety of more advanced devices to provide forward motion of a tubular string in a directional or substantially horizontal well may be attached to the downhole casing device, using the torque and rotation to propel forward or provide compressive force to a tubular string.

The rotation of the casing or other tubular string, as provided by the disclosed downhole casing device embodiments, may be used to clean out the borehole of cuttings beds as well as reaming tight holes while running the casing in the hole, especially in the horizontal sections of a borehole. This rotation of the casing may be enhanced with spiraled outer surfaces or ribs at strategic points, to facilitate the removal of the cuttings bed, typically from the bottom of the wellbore, and place the cuttings into the flow path or the circulated fluid for removal from the wellbore.

In yet another embodiment, the downhole casing device embodiments may be used as a tool to clean casing surfaces. For example, cleaning may be accomplished by placing the downhole tool at several points in a work string, and using a variety of conventional cleanout tools, such as wire brushes or rotating casing scrapers, to clean the casing. Such a use may be particularly beneficial in directional and horizontal wells, where surface rotation is more difficult and result in unacceptable torque in the wellbore.

Another application of the downhole casing device embodiments is as a drilling device, for applications such as drilling with casing. In this application, a motor could supply torque to a casing bit, saving the rest of the casing string from high torque loads.

Yet another embodiment of the downhole casing device would comprise placement of a bit or mill below a downhole casing device so as to provide a cleanout tool during workover operations. The downhole casing device could be assembled in the field at the rig (by installation in a tubing or casing joint) or could be delivered fully assembled for use.

Another application of the disclosed downhole casing device embodiments is as a casing shoe designed to cut through bridges or other obstructions during casing running. Such an application may preclude tripping back to surface, running clean out tools, and rerunning casing. Another application of the disclosed downhole casing device embodiments would involve placement of under-reamer arms on the exterior of the tool to allow use of the device as an under reamer.

Another embodiment comprises use of the casing rotation device with an outer spiraling feature, designed to provide thrust for the casing and to provide an axial force on the casing to push the casing to the distal portion of the wellbore. This forward motion "wellbore tractor" would be similar to those of experimental tractors that employ screw designs to propel the tractor forward in areas of heavy mud.

The rotation of the casing or other tubular string, as enabled by the invention, may be used to clean out the borehole of cuttings beds as well as reaming tight holes while running the casing in the hole, especially in the horizontal sections of a borehole. This rotation of the casing may be enhanced with spiraled outer surfaces or ribs at strategic points. Such a configuration may facilitate the removal of the cuttings bed, typically from the bottom of the wellbore, and place the cuttings into the flow path or the circulated fluid for removal from the wellbore.

Another embodiment provides use of the device as a tool to clean casing surfaces. This would be accomplished by placing the tool at several points in a work string, and using a variety of conventional cleanout tools, such as wire brushes or rotating casing scrapers, to clean the casing. This may be particularly useful in directional and horizontal wells, where surface rotation is more difficult and result in unacceptable torque in the wellbore.

Yet another embodiment provides placing a bit or mill below the disclosed tool for use as a cleanout tool during workover operations. The device may be assembled in the field at the rig by installation in a tubing or casing joint, or may be delivered fully assembled for use.

The disclosed device may improve cement coverage through rotation of the critical bottom section of the casing. A rotating (bottom) nozzle system may further provide an even distribution of cement, by imparting additional torque to the systems as well as swirl to the bottom cement. A further embodiment places under-reamer arms on the exterior of the tool and/or uses the disclosed tool as an under reamer.

In some embodiments of the downhole casing device, the inner member be easily drillable but essentially rigid and could be manufactured by techniques comprising injection molding of plastics, resins or composite materials such as resin-glass fiber systems, and cement. A downhole casing tool comprising cement may be formed in the tool or formed externally and then fastened to the outer housing by adhesives, set screws or other methods well known to one of skill in the art. Furthermore, the downhole casing device inner member may also be manufactured of a soft metal that is drillable, such as a cast iron, or other metals used in drillable tools that are known in the art. In other embodiments, it may be desirable to make the inner member of materials that are non-drillable, such as the metals used in "turbodrills".

In yet another embodiment, the downhole casing device comprises "disappearing" material, as disclosed in, e.g., U.S. Pat. Nos. 6,220,350; 6,712,153; 6,896,063 and 8,425,651, each of which are incorporated by reference in their entireties. In other embodiments, the downhole casing device comprises disposable materials and/or is constructed to be disposable, and may comprise degradable polymers as disclosed in, e.g. U.S. Pat. Publ. Nos. 2005/0205264; 2005/0205265 and 2005/0205266, each of which are incorporated by reference in their entireties. The use of the disappearing and/or disposable materials may eliminate or greatly reduce the need to clean out these tools by conventional drilling or milling operations.

The disclosed downhole casing device embodiments may, among other things, improve cement coverage through rotation of the critical bottom section of the casing and provide a more even distribution of cement by way of a rotating nozzle system. Such a rotating nozzle system may impart additional torque to the systems as well as swirl to the cement at the bottom of a casing string.

By way of providing additional background, context, and to further satisfy the written description requirements of 35 U.S.C. § 112, the following references are incorporated by reference in their entireties: U.S. Pat. Appl. Publ. Nos. 2014/0219836 to Houst, entitled "Axial Turbine with Meridionally Divided Turbine Housing," published Aug. 7, 2014 and 2012/0007364 to David, entitled "Brushless DC Turbo-Hydro Electric Generator," published Jan. 12, 2012; Enenbach, "Straight-Hole Turbodrilling." *American Institute of Mining, Metallurgical, and Petroleum Engineers, Inc.*, Eastman Whipstock U.K. Ltd. Copyright 1977; and Seale et al. "Optimizing Turbodrill Designs for Coiled Tubing Applications," *Society of Petroleum Engineers*, Inc., SPE International, September 2004.

What is claimed is:

1. A tubular section of casing that is adapted to rotate in a wellbore, comprising:

an exterior surface, an upper end, a lower end, and an interior geometry defining a cavity, wherein the interior geometry is formed of a drillable material; and a non-rotating rotor positioned within the cavity of the tubular section of casing, wherein the interior geometry has a configuration to impart a torsional force to the tubular section of casing when a cement is pumped through the cavity and past the non-rotating rotor during a cement job of the wellbore.

2. The tubular section of casing of claim 1, wherein the interior geometry has a spiraled geometric pattern, and wherein the non-rotating rotor has an exterior geometry comprising two helical grooves which form a double helix.

3. The tubular section of casing of claim 1, wherein the tubular section of casing rotates around the non-rotating rotor as the cement progresses from the upper end to the lower end.

4. The tubular section of casing of claim 1, wherein the interior geometry is a drillable cementitious material, and wherein the non-rotating rotor is formed of a drillable material.

5. The tubular section of casing of claim 1, wherein the tubular section of casing is adapted to operably interconnect to an upper tubular with a rotatable transition element positioned above the upper end, wherein casing below the rotatable transition element rotates when the cement is pumped through the cavity.

6. The tubular section of casing of claim 5, wherein the rotatable transition element is operable to allow a lower tubular to rotate while the upper tubular above the rotatable transition element does not rotate.

7. The tubular section of casing of claim 1, wherein the interior geometry defines a stator that is configured to rotate around the non-rotating rotor.

8. The tubular section of casing of claim 7, further comprising a rotation element to decouple the rotation of the stator from the non-rotating rotor, and wherein the non-rotating rotor is held in a fixed position on both an uphole end of the non-rotating rotor and a downhole end of the non-rotating rotor.

9. The tubular section of casing of claim 1, wherein an upper portion and a lower portion of the non-rotating rotor are each secured to a non-rotating portion of the tubular section of casing.

10. The tubular section of casing of claim 1, wherein the tubular section of casing is positioned above a casing shoe.

11. The tubular section of casing of claim 10, wherein the tubular section of casing is positioned below a float collar.

12. A method for rotating casing in a wellbore, comprising:

providing a tubular section of casing including an interior geometry defining a cavity, the interior geometry being formed of a drillable material, an exterior surface, an upper end and a lower end, at least one of the upper end and the lower end being interconnected to the casing, and a rotor positioned within the cavity, wherein the interior geometry is configured to impart a torsional force to the tubular section of casing when cement is pumped through the cavity and past the rotor;

interconnecting the upper end of the tubular section of casing to a downhole end of a first casing section;

interconnecting a transition element with a rotating section to an uphole end of the first casing section above the tubular section of casing;

pumping cement down the wellbore and through the tubular section of casing during a cement job of the wellbore; and wherein hydraulic energy from the cement transfers a rotational force to the tubular section of casing which imparts the torsional force to the first casing section below the transition element.

13. The method of claim 12, wherein the tubular section of casing is positioned above a casing shoe.

14. The method of claim 12, wherein the interior geometry of the tubular section of casing has an inwardly spiraled geometric pattern, and wherein the rotor has an outwardly spiraled geometric pattern.

15. The method of claim 12, wherein as the tubular section of casing rotates around the rotor, the cement progresses from the upper end to the lower end of the tubular section of casing.

16. The method of claim 15, wherein the rotor does not rotate with the tubular section of casing.

17. The method of claim 12, wherein the drillable material forming the interior geometry of the tubular section of casing comprises a drillable cementitious material.

18. A system for rotating a predetermined casing section within a horizontal section of a wellbore during a cementing operation, comprising:

a tubular section of casing including:

an interior geometry defining a cavity and comprising a drillable cementitious material that defines a stator;

an exterior surface; and an upper end and a lower end, wherein the lower end is configured to engage the predetermined casing section; and a rotor positioned within the cavity, the rotor including an uphole portion and a downhole portion that are each secured to a non-rotating portion of the tubular section of casing such that the rotor does not rotate with respect to the tubular section of casing, wherein the interior geometry of the tubular section of casing has a configuration to impart a torsional force to the tubular section of casing when a fluid is pumped through the cavity and past the rotor, and wherein the tubular section of casing is configured to transfer the torsional force to the predetermined casing section, thereby rotating the predetermined casing section as the fluid is pumped through the tubular section of casing.

19. The system of claim 18, wherein the rotor is formed of a drillable material, and wherein the fluid flows between the rotor and the stator to impart hydraulic energy to rotate the predetermined casing section.

20. The system of claim 18, wherein the fluid is a cement.

* * * * *